US011798715B2

(12) United States Patent
Lee et al.

(10) Patent No.: US 11,798,715 B2
(45) Date of Patent: Oct. 24, 2023

(54) MN—BI—SB-BASED MAGNETIC SUBSTANCE AND METHOD OF MANUFACTURING THE SAME

(71) Applicants: Hyundai Motor Company, Seoul (KR); Kia Motors Corporation, Seoul (KR); Industry-University Cooperation Foundation Hanyang University ERICA Campus, Gyeonggi-do (KR)

(72) Inventors: Tae Gyu Lee, Seoul (KR); Jin Hyeok Cha, Gyeonggi-do (KR); Jong Ryoul Kim, Seoul (KR); Min Kyu Kang, Daegu (KR)

(73) Assignees: Hyundai Motor Company, Seoul (KR); Kia Motors Corporation, Seoul (KR); Industry-University Cooperation Foundation Hanyang University ERICA Campus, Gyeonggi-do (KR)

( * ) Notice: Subject to any disclaimer, the term of this patent is extended or adjusted under 35 U.S.C. 154(b) by 154 days.

(21) Appl. No.: 16/928,574

(22) Filed: Jul. 14, 2020

(65) Prior Publication Data

US 2021/0183547 A1 Jun. 17, 2021

(30) Foreign Application Priority Data

Dec. 13, 2019 (KR) ..... 10-2019-0167257

(51) Int. Cl.
*H01F 1/047* (2006.01)
*C22C 30/00* (2006.01)

(52) U.S. Cl.
CPC ..... *H01F 1/047* (2013.01); *C22C 30/00* (2013.01); *C22C 2202/02* (2013.01)

(58) Field of Classification Search
None
See application file for complete search history.

(56) References Cited

FOREIGN PATENT DOCUMENTS

KR 101535487 B1 7/2015

OTHER PUBLICATIONS

Nguyen (Physica B: Condensed Matter, 552 (2019) 190-194, Published on Oct. 4, 2018. (Year: 2018).*
Cui (Acta Materialia, 79 (2014) 374-381). (Year: 2014).*

* cited by examiner

*Primary Examiner* — Xiaowei Su
(74) *Attorney, Agent, or Firm* — Fox Rothschild LLP

(57) ABSTRACT

Disclosed are a Mn—Bi—Sb-based magnetic substance and a method of manufacturing the same. Particularly, the Mn—Bi—Sb-based magnetic substance includes Mn and Bi forming a hexagonal crystal structure, and a portion of Bi elements forming the crystal structure is substituted with Sb so as to improve the magnetic properties thereof.

8 Claims, 8 Drawing Sheets

MN—BI—SB-BASED MAGNETIC SUBSTANCE AND METHOD OF MANUFACTURING THE SAME

CROSS REFERENCE TO RELATED APPLICATION

The present application claims priority to Korean Patent Application No. 10-2019-0167257, filed Dec. 13, 2019, the entire content of which is incorporated herein for all purposes by this reference.

TECHNICAL FIELD

The present invention relates to a Mn—Bi—Sb-based magnetic substance and a method of manufacturing the same. Particularly, the Mn—Bi—Sb-based magnetic substance may include a portion of Bi elements which is substituted with Sb to improve magnetic properties.

BACKGROUND

A magnetic material is a material used to bi-directionally convert electrical energy and mechanical energy, and is a core material widely used for high-efficiency motors and generators.

The magnetic material include soft magnetic material and hard magnetic material, which may be different in magnitude of the external magnetic field in which the direction of magnetic poles is capable of being changed. Hard magnetic materials, for example, may include permanent magnets, that generally generate magnetic fields at all times because the magnetic poles are aligned in a constant direction through magnetization. This magnetic field may be used to generate torque without the application of additional energy supply.

The performance of a permanent magnet may be represented by a B×H value, which is the product of the external magnetic field (H) applied to the magnet and the magnetic field (B) provided by the magnet at an operating point thereof, and the maximum value is defined as the maximum magnetic energy product ((BH)max), and represents the performance index of the permanent magnet.

Recently, in the transportation and energy industries, magnetic materials have been used as the main power converters in an auxiliary position, which increases the demand for high-performance permanent magnets in next-generation industries.

In particular, the demand for electric vehicles has been rapidly increasing due to the increase in the importance of replacing petroleum energy sources and developing low-carbon-emitting green industries in recent years. For this reason, the demand for magnetic materials for permanent magnets is continuously increasing according to the trend toward higher efficiency, lighter weight, and smaller size of motors used in electric vehicles.

For example, ferrite and Nd-based magnets have been most widely used as magnetic materials. The Nd-based magnet requires only about ⅛ of the volume of a ferrite magnet to obtain the same energy as the ferrite magnet. Therefore, the ferrite-based magnet is used for low-cost and low-performance products, and the Nd-based magnet, having a high maximum magnetic energy product, is used for high-efficiency and high-performance products.

In the case of the Nd-based magnet, the maximum magnetic energy product of the magnet reaches a theoretical value when manufactured. On the other hand, the Nd-based magnet contains heavy rare earth elements such as Dy and Tb in order to improve coercivity when used in motors due to the low thermal stability thereof. However, in the case of heavy rare earth resources, there is a problem in that the heavy rare earth resources reduce the remanence (remanent magnetization) of the Nd-based magnet, thus lowering a maximum magnetic energy product as a whole. Further, the rare earth elements are expensive due to the geographically imbalanced distribution of resources and resource weaponization using the imbalanced distribution.

Therefore, research has been conducted into a material for non-rare-earth permanent magnets having a new composition, which has a reduced amount of heavy rare earth elements or does not contain the rare earth elements unlike conventional rare earth magnets.

Among the materials for the non-rare-earth permanent magnet, a Mn—Bi-based magnet has a maximum magnetic energy product greater than that of the ferrite-based magnet and has coercivity higher than that of the Nd-based magnet at high temperatures. Accordingly, the Mn—Bi-based magnet has been actively studied because there is a merit in that the fuel efficiency of automobiles is improved through miniaturization, reduced weight, and increased efficiency of motors.

The Mn—Bi-based magnet has a theoretical maximum magnetic energy product ((BH)max) of 17.7 MGOe, meaning excellent magnetic properties, and also has a high uniaxial crystal magnetic anisotropic energy property ($2.2\times10^7$ erg/cm$^3$ (at 500K)). The Mn—Bi-based magnet has coercivity greater than that of the Nd-based magnet at a high temperature (200° C.).

The technology for synthesizing the Mn—Bi-based magnet may include thin-film process and powder process.

For example, in the thin-film process, an LTP-MnBi phase is generated through heat treatment after the deposition of Mn and Bi layers using a sputtering method. Therefore, the property change depending on the type of substrates and the in-situ heat-treatment process variables are important.

In the powder process, a magnetic ribbon is manufactured using a Mn—Bi ingot, and powder formation and bulking are then performed through heat treatment and pulverization processes. In order to increase the LTP-MnBi content, it is important to control melt-spinning process and heat treatment conditions.

Meanwhile, when the Mn—Bi-based magnet is manufactured using the thin-film process, a high saturation magnetization value may be obtained, but it is impossible to manufacture the Mn—Bi-based magnet in an industrially available bulk form.

In addition, when the Mn—Bi-based magnet is manufactured using the powder process, it is difficult to manufacture an LTP-MnBi single phase. Further, there are problems in that magnetic properties are deteriorated due to the formation of Mn oxides and phase decomposition of LTP-MnBi during powder formation and in that a theoretical maximum magnetic energy product is relatively low compared to Nd-based hard magnetic materials ($Nd_2Fe_{14}B$ theoretical (BH)max=64 MGOe).

The contents described as the background art are only for understanding the background of the present invention, and should not be taken as corresponding to the related arts already known to those skilled in the art.

SUMMARY

In preferred aspects, provided are a Mn—Bi—Sb-based magnetic substance, in which a portion of Bi elements is substituted with Sb to improve magnetic properties, and a method of manufacturing the same.

In an aspect, provided is a Mn—Bi—Sb-based magnetic substance that may include a hexagonal crystal structure formed of materials comprising manganese (Mn) and bismuth (Bi). In particular, a portion of Bi elements forming the crystal structure may be substituted with antimony (Sb).

The substitution amount of Sb may be about 3.0 at % or less.

The Mn—Bi—Sb-based magnetic substance may be represented by $Mn_xBi_{100-x-y}Sb_y$, x is 48 to 56, and y is 3.0 or less.

Preferably, the magnetic substance may be represented by $Mn_{54}Bi_{46-y}Sb_y$ and y is 3.0 or less.

The magnetic substance may include of about 50% or greater of a low-temperature phase of MnBi (LTP-MnBi).

The remaining Bi and Mn oxide (Mn-oxide) phases may not be formed in the magnetic substance.

The magnetic substance may suitably include an amount of about 10 wt % or less of the remaining Bi and Mn oxide (Mn-oxide) phases, based on the total weight of the magnetic substance.

The magnetic substance may suitably have a saturation magnetization value (Ms) of about 38 emu/g or more.

The magnetic substance may suitably have a coercivity (Hc) of 500 Oe or greater.

The hexagonal crystal structure also may be formed of materials consisting essentially of or consisting of manganese (Mn) and bismuth (Bi).

In an aspect, provided is a method of manufacturing an Mn—Bi—Sb-based magnetic substance that may include preparing an intermetallic compound by melting manganese (Mn), bismuth (Bi), and antimony (Sb), preparing a Mn—Bi—Sb-based-mixed melt solution by melting the intermetallic compound, forming a Mn—Bi—Sb-based ribbon by cooling the Mn—Bi—Sb-based-mixed melt solution, and converting the Mn—Bi—Sb-based ribbon into a magnetic Mn—Bi—Sb-based ribbon using heat treatment. Preferably the Mn, Bi and Sb are at least substantially simultaneously melted, i.e. the Mn, Bi and Sb are melted at the or about the same time, or the Mn, Bi and Sb are melted within about 60, 50, 40, 30, 20, 10, 5, 3, 2 or 1 minutes or less of each other.

The preparing the intermetallic compound may include mixing Mn, Bi, and Sb so as to satisfy a ratio of $Mn_xB_{100-x-y}Sb_y$ (where x is 48 to 56 and y is 3.0 or less), followed by cooling, thus preparing a Mn—Bi—Sb-based ingot, which is the intermetallic compound.

The preparing the intermetallic compound may include mixing Mn, Bi, and Sb so as to satisfy a ratio of $Mn_{54}Bi_{46-y}Sb_y$ (where y is 3.0 or less), followed by cooling, thus preparing a Mn—Bi—Sb-based ingot, which is the intermetallic compound.

The forming the Mn—Bi—Sb-based ribbon may include cooling the Mn—Bi—Sb-based-mixed melt solution using a rapid solidification process (RSP) to form a Mn—Bi—Sb as-spun ribbon.

The conversion into the magnetic Mn—Bi—Sb-based ribbon may include heat treating the Mn—Bi—Sb as-spun ribbon at a temperature in a range of about 270 to 330° C.

The conversion into the magnetic Mn—Bi—Sb-based ribbon may include heat treating the Mn—Bi—Sb as-spun ribbon in an inert gas atmosphere for about 12 to 48 hours.

According to various exemplary embodiments of the present invention, a Mn—Bi—Sb-based magnetic substance, in which a portion of Bi elements is simple-substituted with Sb, may be manufactured. The Mn—Bi—Sb-based magnetic substance may have magnetic properties superior to those of the Mn—Bi-based magnetic substance, which is a binary system.

For example, the Mn—Bi—Sb-based magnetic substance may have the increased remanence-magnetization value (Mr), coercivity (Hc), and squareness (Mr/Ms) properties compared to the Mn—Bi-based magnetic substance. For example, the Mn—Bi—Sb-based magnetic substance may have an improved maximum magnetic energy product (an increase of 924.05%) compared to the Mn—Bi-based magnetic substance.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION

Hereinafter, embodiments of the present invention will be described in more detail with reference to the accompanying drawings. However, the present invention is not limited to the embodiments disclosed below but will be implemented in various different forms, and the present embodiments are merely provided to complete the disclosure of the present invention and to fully inform those skilled in the art of the scope of the invention.

The terminology used herein is for the purpose of describing particular exemplary embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

The Mn—Bi—Sb-based magnetic substance in various aspects may be provided based on the fact that, when a different kind of element is added to the Mn—Bi-based magnetic substance, a magnetic substance having magnetic properties superior to those of an Mn—Bi-based magnetic substance is obtained.

Figure 1:
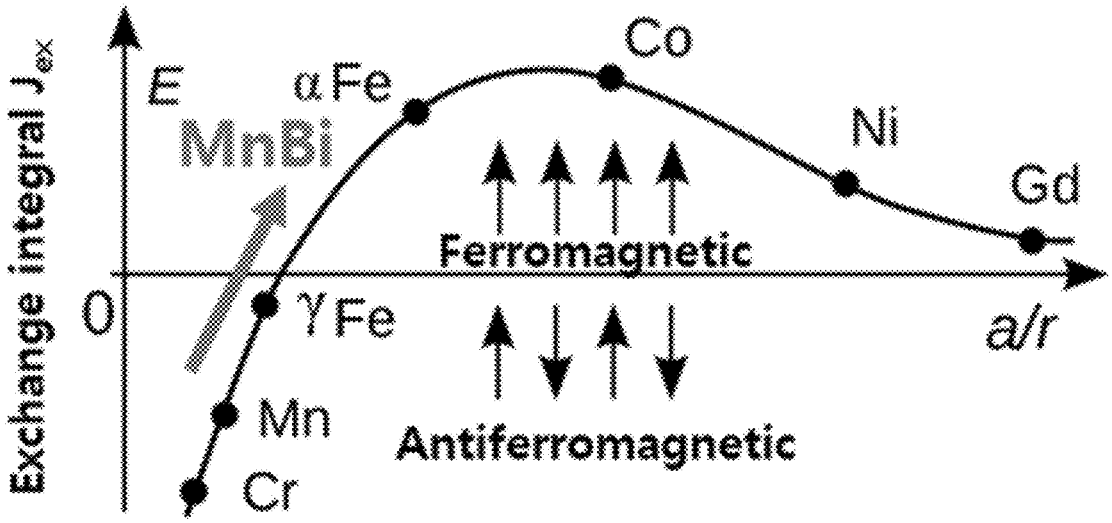
FIG. 1 is a Bethe-Slater curve for explaining the formation of an exemplary Mn—Bi—Sb-based magnetic substance according to an exemplary embodiment of the present invention.
Figure 2:
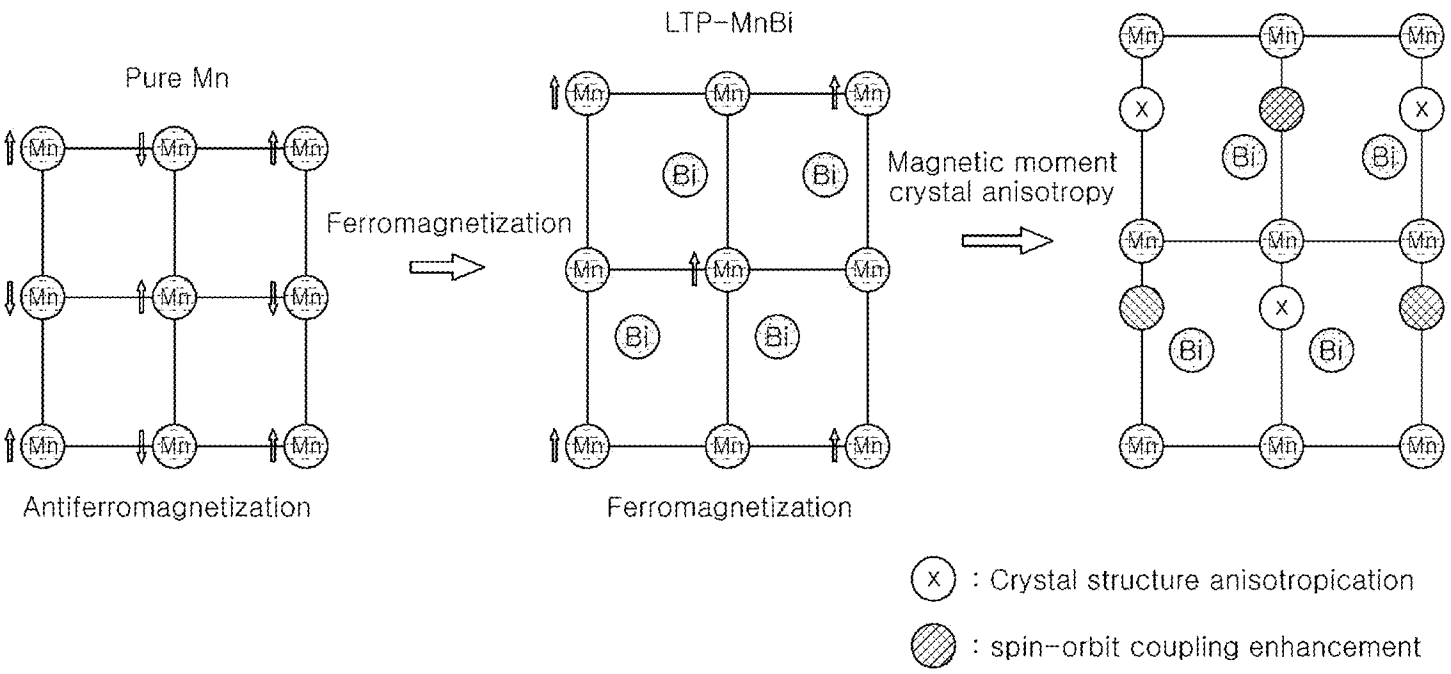
FIG. 2 is a view for explaining the formation of an exemplary Mn—Bi—Sb-based magnetic substance according to an exemplary embodiment of the present invention.

FIG. 1 is a Bethe-Slater curve for explaining the formation of an exemplary Mn—Bi—Sb-based magnetic substance according to an exemplary embodiment of the present invention, and FIG. 2 is a view for explaining the formation of an exemplary Mn—Bi—Sb-based magnetic substance according to an exemplary embodiment of the present invention.

As shown in FIG. 1, a magnetic material, i.e. a magnetic substance, may exhibit ferromagnetic properties only when the value of an exchange integral is positive.

In addition, as shown in FIG. 2, pure Mn is antiferromagnetic, but when Bi is added to form a MnBi alloy, the spacing of Mn atoms may be increased due to lattice expansion.

Accordingly, a/r is increased, so the value of Jex becomes positive, which enables MnBi to have ferromagnetic properties.

For example, when a different kind of element is added to the Mn—Bi-based alloy, a magnetic substance having magnetic properties superior to those of the Mn—Bi-based magnetic substance may be obtained.

Meanwhile, in order to maintain the LTP-MnBi phase when a different kind of element is added to the Mn—Bi-based alloy, methods of Mn site substitution, Bi site substitution, and interstitial site invasion may be used.

Further, elements suitable for the addition and substitution of a different kind of element in the composition of the Mn—Bi-based alloy should have an atomic radius and electronic structure similar to those of the Mn—Bi-based alloy.

Preferably, a portion of Bi elements among the elements constituting the Mn—Bi-based alloy may be substituted with Sb to form the Mn—Bi-based alloy.

In particular, in the Mn—Bi—Sb-based magnetic substance, Mn and Bi may form a hexagonal crystal structure, and a portion of Bi elements forming the crystal structure may be substituted with Sb to form the Mn—Bi—Sb-based magnetic substance.

Figure 3:
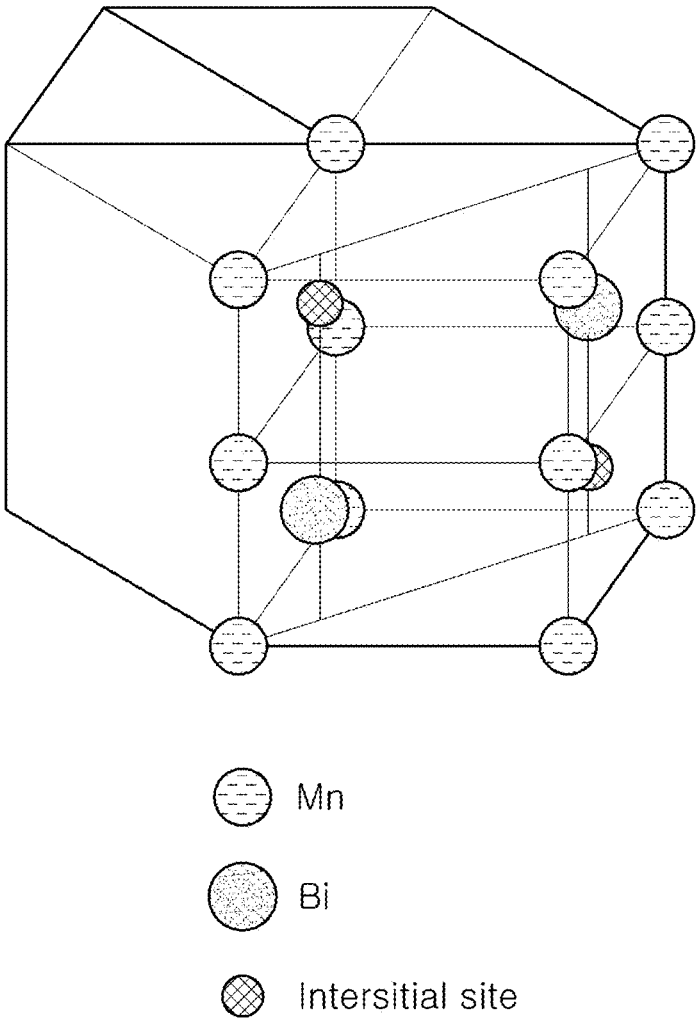
FIG. 3 is a view showing an exemplary crystal structure of LTP-MnBi.

FIG. 3 is a view showing the crystal structure of LTP-MnBi. In the case of the Mn—Bi—Sb-based magnetic substance, Mn and Bi may form a hexagonal crystal structure, and Sb may be substituted at some sites of Bi elements to form the Mn—Bi—Sb-based magnetic substance.

With respect to substitution of Bi with Sb, the substitution amount of Sb may be preferably about 3.0 at % or less.

Thus, the Mn—Bi—Sb-based magnetic substance may be represented by $Mn_xBi_{100-x-y}Sb_y$. Preferably, x is 48 to 56 and y is 3.0 or less. When the content of Mn is in the range of about 48 to 56 at %, Bi and Mn-oxide phases, which negatively affect magnetic substance, may be observed in amounts of about 10 wt % or less based on the total weight of the Mn—Bi—Sb based magnetic substance. In particular, in the Mn—Bi—Sb-based magnetic substance, when the content of Mn is about 54 at %, the Bi and Mn-oxide phases, which negatively affect magnetic substances, are not observed. Therefore, more preferably, the Mn—Bi—Sb-based magnetic substance may be represented by $Mn_{54}Bi_{46-y}Sb_y$. y is preferably 3.0 or less.

Further provided is a method of manufacturing the Mn—Bi—Sb-based magnetic substance.

The method of manufacturing a Mn—Bi—Sb-based magnetic substance may include preparing an intermetallic compound by simultaneously melting Mn, Bi, and Sb, preparing a Mn—Bi—Sb-based-mixed melt solution by melting the intermetallic compound, forming a Mn—Bi—Sb-based ribbon by cooling the Mn—Bi—Sb-based-mixed melt solution, and converting the Mn—Bi—Sb-based ribbon into a magnetic Mn—Bi—Sb-based ribbon using heat treatment.

The preparation of the intermetallic compound may include preparing Mn, Bi, and Sb metal chips with a purity of 99.99% or greater. In addition, the prepared Mn, Bi, and Sb may be mixed so as to satisfy a ratio of $Mn_xBi_{100-x-y}Sb_y$ (where x is 48 to 56 and y is 3.0 or less), followed by cooling, thus preparing a Mn—Bi—Sb-based ingot, which is the intermetallic compound.

In further detail, the prepared Mn, Bi, and Sb may be mixed so as to satisfy a ratio of $Mn_xBi_{100-x-y}Sb_y$ (where x is 48 to 56 and y is 3.0 or less) and then placed on a copper floor cooled using water cooling, followed by a plasma-arc melting process, thus manufacturing a Mn—Bi—Sb-based ingot. A re-melting process may be repeated four times in order to improve the uniformity of the metals in the ingot. Particularly, the prepared Mn, Bi, and Sb may be mixed so as to satisfy a ratio of $Mn_{54}Bi_{46-y}Sb_y$ (where y is 3.0 or less).

In the preparation of the Mn—Bi—Sb-based-mixed melt solution, the Mn—Bi—Sb-based ingot may suitably be placed in a quartz tube and then melted through rapid induction heating in an inert Ar gas atmosphere, thereby manufacturing the Mn—Bi—Sb-based-mixed melt solution.

The formation of the Mn—Bi—Sb-based ribbon may suitably cooling the prepared Mn—Bi—Sb-based-mixed melt solution using a rapid solidification process (RSP), thereby forming a Mn—Bi—Sb as-spun ribbon.

For example, the prepared Mn—Bi—Sb-based-mixed melt solution may be sprayed onto the surface of the rotating metal copper wheel at a speed of about 50 m/s to rapidly cool the Mn—Bi—Sb-based-mixed melt solution, thereby obtaining a Mn—Bi—Sb as-spun ribbon. This melt-spinning process may be performed in a sufficiently high-purity Ar gas atmosphere.

The conversion into the magnetic Mn—Bi—Sb-based ribbon may suitably include heat treating the Mn—Bi—Sb as-spun ribbon at a temperature in the range of about 270 to 330° C. to homogenize the Mn, Bi, and Sb atoms in the ribbon.

For example, in order to obtain the desired hard magnetic phase, an inert gas atmosphere may be created in a quartz tube furnace, and the Mn—Bi—Sb as-spun ribbon may be charged into the quartz tube furnace and then heat-treated at a temperature in the range of about 270 to 330° C. for about 12 to 48 hours.

Example

The present invention will be described with reference to Comparative Examples and Examples.

Figure 4:
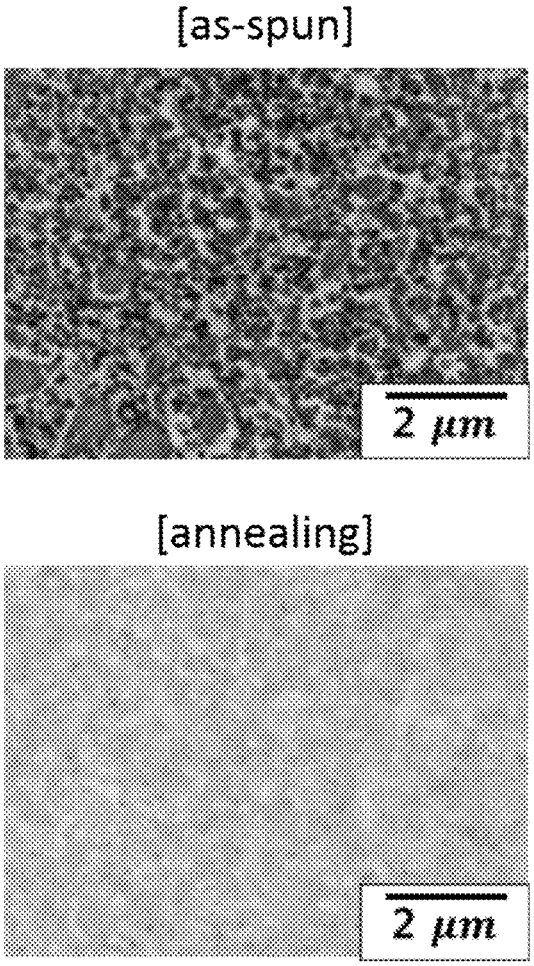
FIG. 4 is a view obtained by comparing an exemplary Mn—Bi—Sb-based magnetic substance according to an exemplary embodiment of the present invention, before and after heat treatment thereof.

The microstructure of the Mn—Bi—Sb as-spun ribbon was observed before and after heat treatment, and the results are shown in FIG. 4.

The Mn—Bi—Sb as-spun ribbon was manufactured according to an exemplary manufacturing method according to an exemplary embodiment of the embodiment of the present invention, and had the alloy component composition of $Mn_{54}Bi_{44.5}Sb_{1.5}$.

FIG. 4 is a view obtained by comparing an exemplary Mn—Bi—Sb-based magnetic substance according to an exemplary embodiment of the present invention, before and after heat treatment thereof.

As shown FIG. 4, in the Mn—Bi—Sb as-spun ribbon before heat treatment, crystal grains having a size of less than about 1 um were finely mixed. As a result of EDS analysis, Mn—Bi—Sb (dark gray) and Mn—Bi (gray) regions were identified.

The Mn—Bi—Sb region may be a quenched high-temperature phase (QHTP), the formation of which is promoted by Sb.

Meanwhile, the Mn, Bi, and Sb atoms may be homogenized in the Mn—Bi—Sb ribbon after heat treatment.

Next, the X-ray diffraction pattern of the Mn—Bi—Sb-based magnetic substance according to the change in the content of Sb was analyzed, and the mass fraction of each phase was calculated according to the results thereof. The results are shown in FIGS. 5 and 6 and in Table 1.

The mass fraction (wt %) of each phase was calculated using a Rietveld refinement method, a Jade 9.5 program, and the obtained X-ray diffraction pattern.

Figure 5:
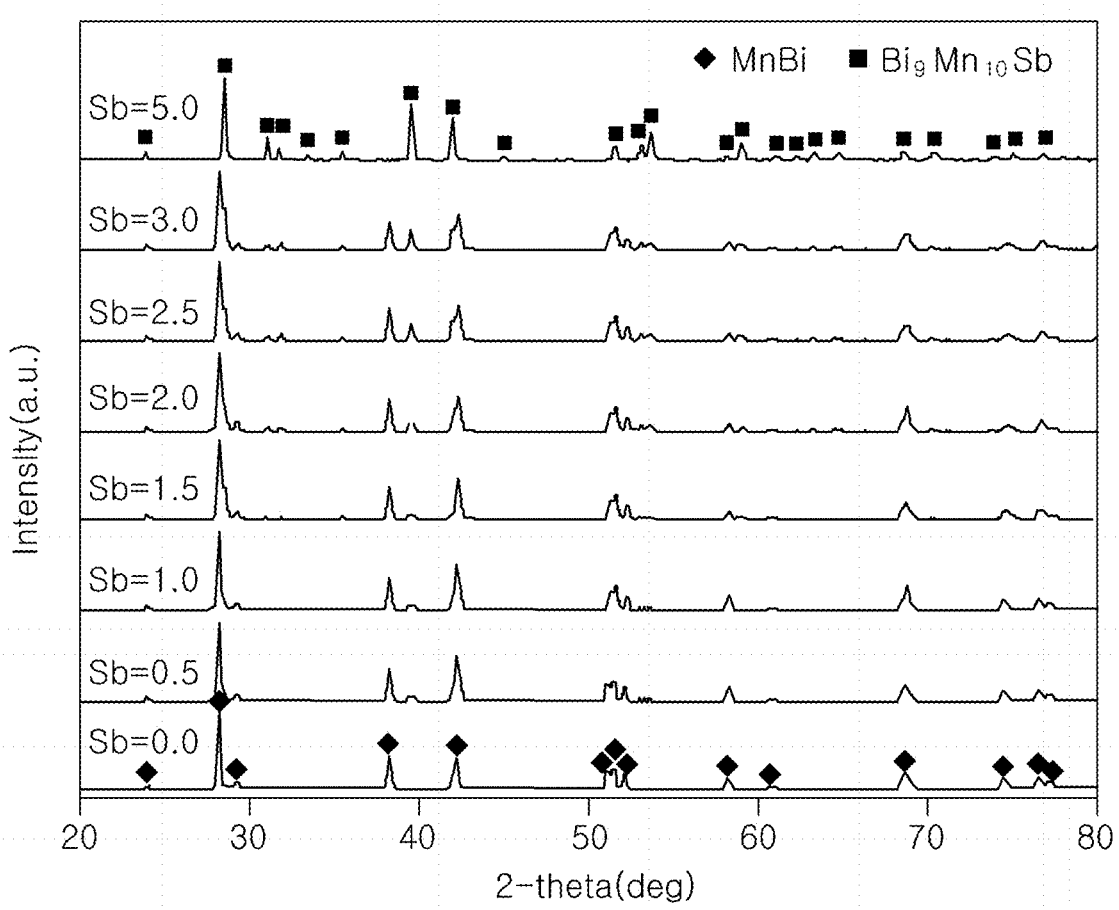
FIGS. 5 and 6 are views showing the X-ray diffraction pattern of exemplary Mn—Bi—Sb-based magnetic substances according to the change in the content of Sb.
Figure 6:
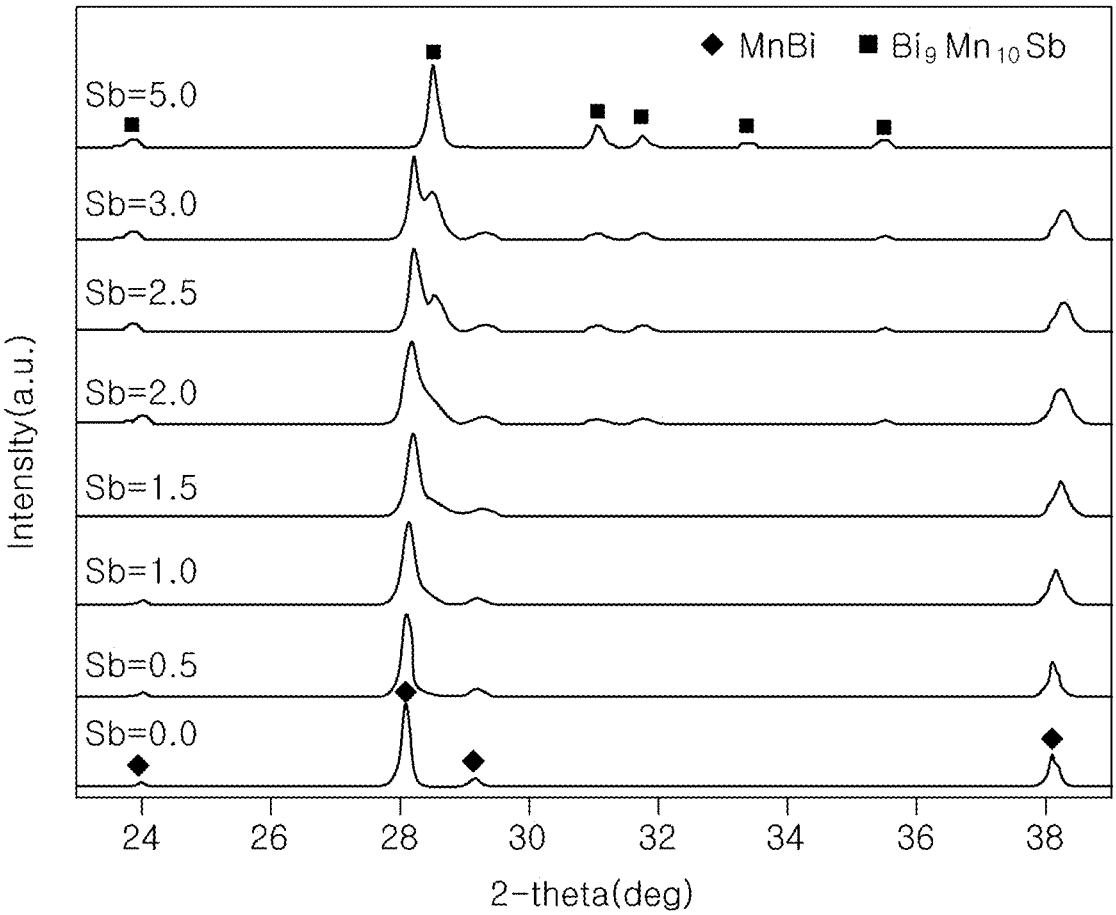

FIGS. 5 and 6 are views showing the X-ray diffraction pattern of the Mn—Bi—Sb-based magnetic substance according to the change in the content of Sb. Table 1 shows the mass fraction of each phase according to the change in the content of Sb.

TABLE 1

| Substitution amount of Sb (y) | LTP-MnBi (wt %) | $Bi_9Mn_{10}Sb$ (wt %) |
|---|---|---|
| 0.0 | 100 | — |
| 0.5 | 100 | — |
| 1.0 | 88.2 | 11.8 |
| 1.5 | 83.7 | 16.3 |
| 2.0 | 80.7 | 19.3 |
| 2.5 | 61.9 | 38.1 |
| 3.0 | 55.3 | 44.7 |
| 5.0 | — | 100 |

As shown in FIG. 5 and Table 1, the samples were magnetic ribbons having a composition of $Mn_{54}Bi_{46-y}Sb_y$, in which the substitution amount y of Sb was changed to be 0, 0.5, 1.0, 1.5, 2.0, 2.5, 3.0 and 5.0, and X-ray diffraction patterns obtained by heat treating the samples in an Ar gas atmosphere at 300° C. for 24 hrs are shown.

For example, a LTP-MnBi single phase was formed when y is 0, and a $Bi_9Mn_{10}Sb$ phase as formed when the content of Sb was increased.

In addition, the weight fraction of the LTP-MnBi phase was reduced as the substitution amount of Sb was increased, and was 0 wt % under the condition of y of 5.0.

Meanwhile, the Bi phase or Mn-oxide phase was not observed in the diffraction pattern of $Mn_{54}Bi_{46-y}Sb_y$, because, for example, the composition and heat treatment conditions of Mn—Bi—Sb were optimized.

The Bi or Mn-oxide phase negatively affecting the magnetic substance was a phase generated during heat treatment, and did not exhibit hard magnetic properties. The Bi phase or Mn-oxide phase reduced the magnetic properties of the magnetic substance relative to the total volume or weight thereof (emu/$cm^3$ or emu/g).

Further, from the observation of the formation of the Mn-oxide phase during the heat-treatment process, oxides appeared because the heat-treatment process was not fully optimized, which m a cause for the rapid decrease in the magnetic properties of the magnetic substance.

FIG. 6 shows a change in the position of the 101 peak, which is the main peak of the LTP-MnBi phase in the X-ray diffraction pattern of the Mn—Bi—Sb magnetic ribbon, according to the substitution amount of Sb.

As the content of Sb was increased until y became 3, the main peak of LTP-MnBi shifted to a greater angle (high-angle shift). This indicates that the lattice of the crystal structure shrank and that the substitution of Sb atoms affected the lattice constant of LTP-MnBi.

In addition, the Bi and Sb atoms had radii of 156 pm and 140 pm (empirical size), respectively, and lattice shrinkage of the LTP-MnBi crystal structure occurred as the Bi atom is substituted by the Sb atom, which is consistent with a change in the position of the main peak of LTP-MnBi.

Figure 7:
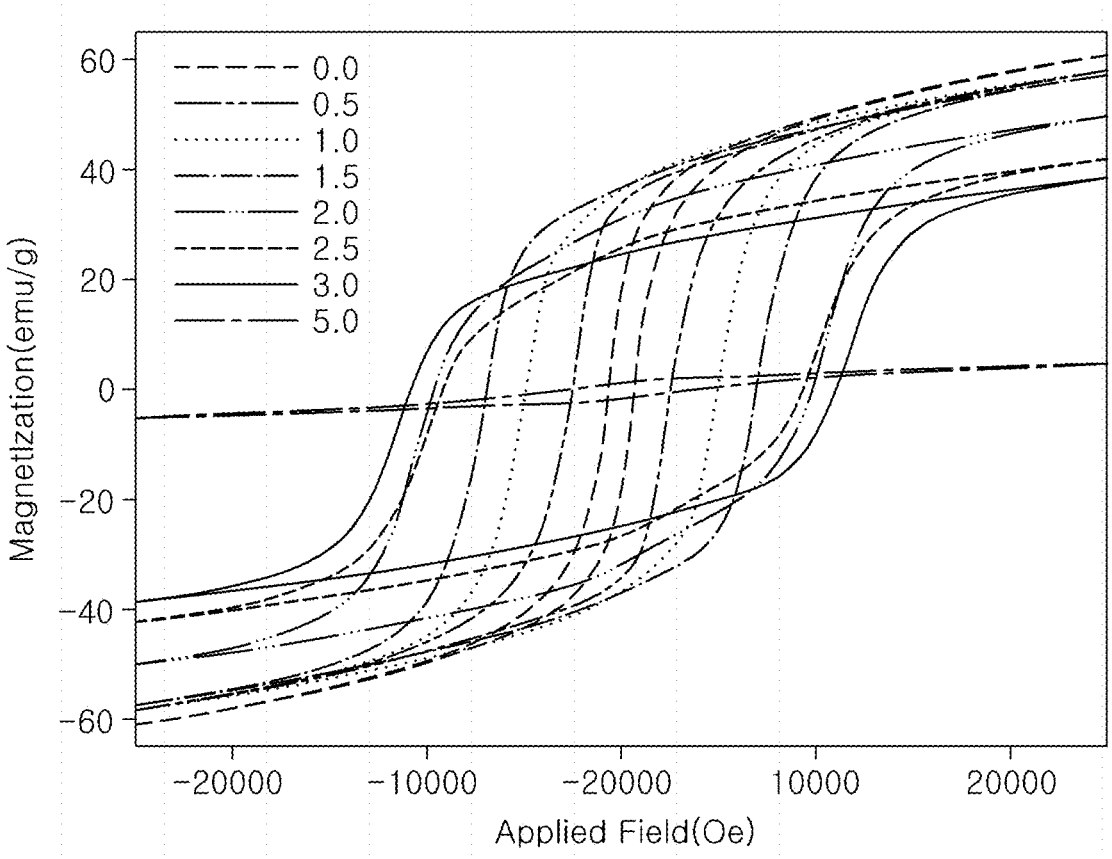
FIG. 7 is a view showing a magnetic hysteresis curve of an exemplary Mn—Bi—Sb-based magnetic substance according to the change in the content of Sb.
Figure 8:
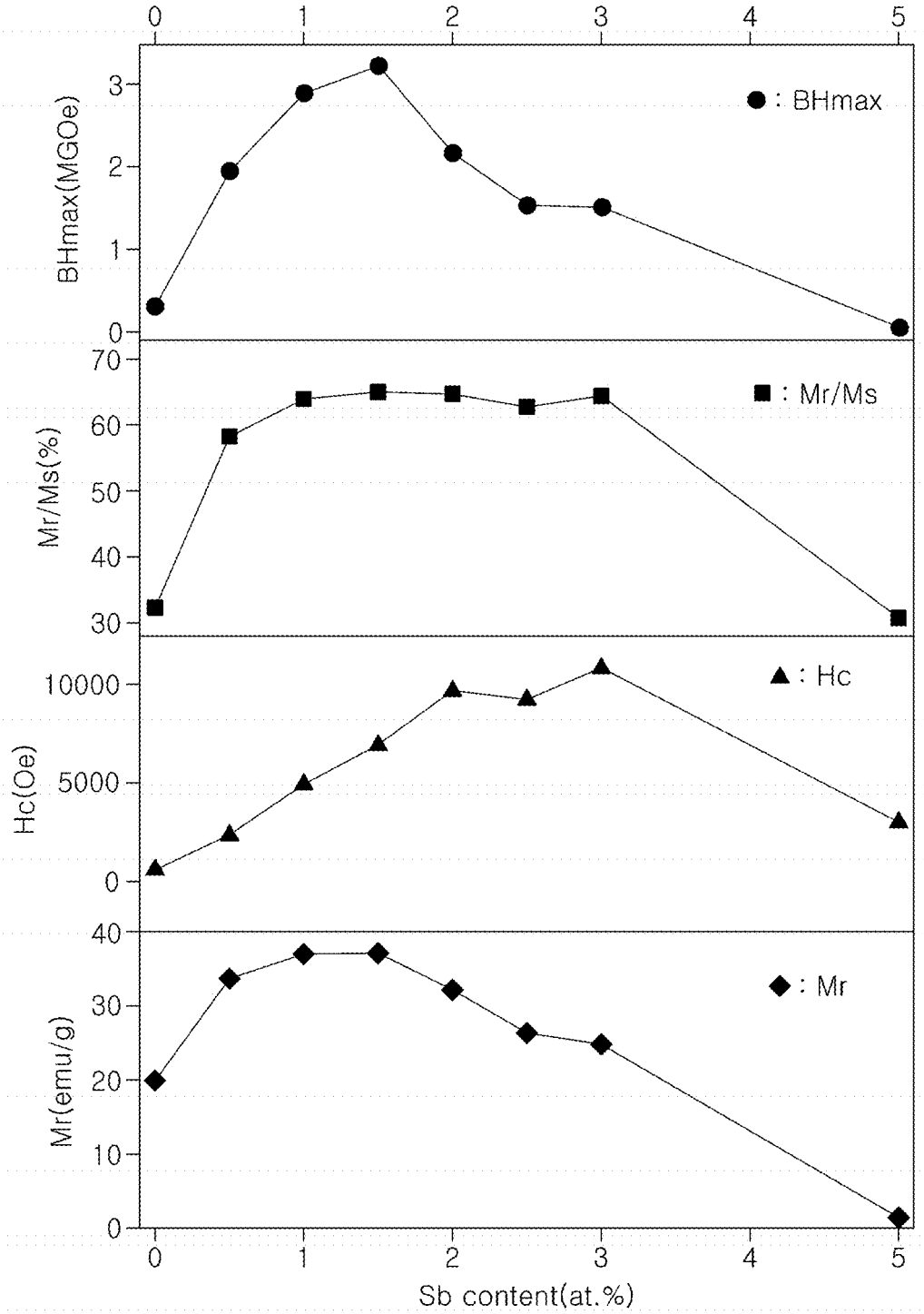
FIG. 8 is a view showing the magnetic properties of an exemplary Mn—Bi—Sb-based magnetic substance according to the change in the content of Sb.

The magnetic properties of the Mn—Bi—Sb-based magnetic substance according to the change in the content of Sb were checked, and the results are shown in Table 2 and FIGS. 7 and 8. Saturation magnetization was the value measured at a maximum externally applied magnetic field of 25 kOe.

TABLE 2

| Substitution amount of Sb (y) | Saturation magnetization (emu/g) | Remanence magnetization (emu/g) | Squareness (%) | Coercivity (Oe) | Maximum magnetic energy product (MGOe) |
|---|---|---|---|---|---|
| 0.0 | 60.960 | 19.726 | 32.259 | 745.12 | 0.316 |
| 0.5 | 57.741 | 33.715 | 58.389 | 2437.5 | 1.961 |
| 1.0 | 58.057 | 37.120 | 63.938 | 4976.7 | 2.906 |
| 1.5 | 57.195 | 37.237 | 65.105 | 6986.6 | 3.236 |
| 2.0 | 49.873 | 32.222 | 64.611 | 9659.9 | 2.173 |
| 2.5 | 42.003 | 26.349 | 62.733 | 9239.8 | 1.542 |
| 3.0 | 38.430 | 24.783 | 64.490 | 10886 | 1.501 |
| 5.0 | 4.8765 | 1.5030 | 30.820 | 3062.4 | 0.044 |

FIGS. 7 and 8 show the magnetic properties of the Mn—Bi—Sb-based magnetic substance according to the change in the content of Sb. FIG. 7 shows a magnetic hysteresis curve, and FIG. 8 shows a maximum magnetic energy product ((BH)max), squareness (Mr/Ms), coercivity (Hc), and a remanence magnetization value (Mr).

As shown in Table 2 and FIG. 7, the saturation magnetization value (Ms) was reduced as the substitution amount of Sb was increased, and was reduced rapidly starting when y was 2.0. This is consistent with the X-ray diffraction (XRD) analysis result, because, for example, the phase fraction of $Bi_9Mn_{10}Sb$, which is a nonmagnetic phase, was increased as the content of Sb is increased.

In addition, as shown in FIG. 7, ferromagnetic properties were not exhibited in a magnetic hysteresis curve when y is 5. This is because, for example, a $Bi_9Mn_{10}Sb$ single phase having nonmagnetic properties was formed when y is 5.

The Mn—Bi—Sb magnetic ribbon may have hard magnetic properties when y is 3.0 or less. Particularly, the Mn—Bi—Sb magnetic substance may have a saturation magnetization value (Ms) of 38 emu/g or greater and a coercivity (Hc) of 500 Oe or more when y is 3.0 or less.

In addition, as shown in FIG. 8, the coercivity (Hc), squareness (Mr/Ms), and remanence magnetization value (Mr) were increased in the ribbon shape as the substitution amount of Sb was increased, because, for example, the substitution of Sb elements affected the anisotropic properties of the Mn—Bi—Sb magnetic ribbon.

Further, the improvement of anisotropic properties due to the substitution of Sb may have a major effect on the remanence magnetization, coercivity, and squareness, which results in an improvement in the maximum magnetic energy product.

For example, the coercivity was increased by 837.65% and the maximum magnetic energy product was increased by 924.05% in the composition where y was 1.5, compared to the conventional condition, in which y is 0.

Although the present invention has been described with reference to the accompanying drawings and the preferred embodiments described above, the present invention is not limited thereto but is defined by the appended claims. Accordingly, one of ordinary skill in the art may variously transform and modify the present invention without departing from the technical spirit of the appended claims.

What is claimed is:

1. A Mn—Bi—Sb-based magnetic substance comprising:

a hexagonal crystal structure formed of materials comprising manganese (Mn) and bismuth (Bi), wherein a portion of Bi elements forming the crystal structure is substituted with antimony (Sb), wherein the magnetic substance is represented by $Mn_{54}Bi_{46-y}Sb_y$ and y is 0.5 to 3.0 at %, wherein the magnetic substance comprises an amount of 50% or greater of a low-temperature phase of MnBi (LTP-MnBi), wherein a Bi and Mn oxide (Mn-oxide) phases are not formed in the magnetic substance, and wherein the magnetic substance has a coercivity (Hc) of 6000 Oe or greater.

2. The Mn—Bi—Sb-based magnetic substance of claim 1, wherein the magnetic substance has a saturation magnetization value (Ms) of 38 emu/g or greater.

3. A Mn—Bi—Sb-based magnetic substance represented by $Mn_{54}Bi_{46-y}Sb_y$ and y is 0.5 to 3.0 at %, wherein the magnetic substance comprises an amount of 50% or greater of a low-temperature phase of MnBi (LTP-MnBi), wherein a Bi and Mn oxide (Mn-oxide) phases are not formed in the magnetic substance, and wherein the magnetic substance has a coercivity (Hc) of 6000 Oe or greater.

4. A method of manufacturing the Mn—Bi—Sb-based magnetic substance according to claim 1, comprising:

preparing an intermetallic compound by steps comprising melting materials comprising manganese (Mn), bismuth (B1), and antimony (Sb);

preparing a Mn—Bi—Sb-based-mixed melt solution by steps comprising melting the intermetallic compound;

forming a Mn—Bi—Sb-based ribbon by steps comprising cooling the Mn—Bi—Sb-based-mixed melt solution; and converting the Mn—Bi—Sb-based ribbon into a magnetic Mn—Bi—Sb-based ribbon using heat treatment.

5. The method of claim 4, wherein the preparing the intermetallic compound comprises mixing Mn, Bi, and Sb so as to satisfy a ratio of $Mn_{54}Bi_{46-y}Sb_y$ wherein y is 0.5 to 3.0 at %, followed by cooling, thus preparing a Mn—Bi—Sb-based ingot, which is the intermetallic compound.

6. The method of claim 4, wherein the forming the Mn—Bi—Sb-based ribbon comprises cooling a Mn—Bi—Sb-based-mixed melt solution using a melt-spinning process to form a Mn—Bi—Sb as-spun ribbon.

7. The method of claim 6, wherein the converting into the magnetic Mn—Bi—Sb-based ribbon comprises heat treating the Mn—Bi—Sb as-spun ribbon at a temperature in a range of about 270 to 330° C.

8. The method of claim 7, wherein the converting into the magnetic Mn—Bi—Sb-based ribbon comprises heat treating the Mn—Bi—Sb as-spun ribbon in an inert gas atmosphere for about 12 to 48 hours.

* * * * *